United States Patent [19]

Westfall et al.

[11] Patent Number: 4,885,871

[45] **Date of Patent: * Dec. 12, 1989**

[54] AUDIBLY LOCKING SHOE SYSTEM FOR TAKE-OUT WINDOW

[75] Inventors: Norman R. Westfall; James A. Martini; John I. Habbersett, all of Rochester, N.Y.

[73] Assignee: Caldwell Manufacturing Company, Rochester, N.Y.

[ * ] Notice: The portion of the term of this patent subsequent to Jan. 24, 2006 has been disclaimed.

[21] Appl. No.: 249,103

[22] Filed: Sep. 26, 1988

Related U.S. Application Data

[63] Continuation-in-part of Ser. No. 99,894, Sep. 22, 1987, Pat. No. 4,799,333.

[51] Int. Cl.[4] ..... E05D 15/22

[52] U.S. Cl. ..... 49/176; 49/446; 49/453

[58] Field of Search ..... 49/181, 176, 161, 183, 49/453, 454, 446; 292/DIG. 65, DIG. 56, 341.12

[56] References Cited

U.S. PATENT DOCUMENTS

| | | | |
|---|---|---|---|
| 2,688,509 | 9/1954 | Schonitzer | 292/DIG. 56 |
| 2,796,630 | 6/1957 | Haas | 49/181 X |
| 2,987,758 | 6/1961 | Osten, Sr. | 49/181 X |
| 3,197,819 | 8/1965 | Trout | 49/181 X |
| 3,233,278 | 2/1966 | Lundgren | 49/181 X |
| 3,464,157 | 9/1969 | Rodriguez | 49/181 X |
| 4,799,333 | 1/1989 | Westfall et al. | 49/446 |

*Primary Examiner*—Philip C. Kannan

*Attorney, Agent, or Firm*—Stonebracker, Shepard & Stephens

[57] ABSTRACT

A lock shoe system for a take-out window having take-out jamb liners (10) uses a pair of fins (22) extending laterally outward from opposite sides (18) of a sash pin slot (16) in the jamb liner for supporting lock shoes (30) that move vertically in lock shoe channels (13 and 14) within the jamb liners. The lock shoes have pivotally mounted ramp latches (60) that extend over locking devices and are inclined toward recesses (82) for receiving sash pins (25). When a sash (20) is returned to an operating position between jamb liners (10), its sash pins (250 are moved downward over ramp latches (60), pivoting these aside and releasing the lock mechanism, which snaps the pins into the receiving recesses. This produces an audible sound as each pin is latched in its respective shoe (30) so that the user can tell from the sounds made when the latching occurs that sash (20) is properly latched into each shoe, where its weight is counterbalanced.

19 Claims, 5 Drawing Sheets

AUDIBLY LOCKING SHOE SYSTEM FOR TAKE-OUT WINDOW

RELATED APPLICATIONS

This application is a Continuation-In-Part of our copending parent application Ser. No. 099,894, filed Sept. 22, 1987, entitled LOCK SHOE SYSTEM FOR TAKE-OUT WINDOW, now Pat. No. 4,799,333, issued Jan. 24, 1989.

BACKGROUND

The balance systems for take-out sash that can be tilted and removed from between take-out jamb liners have used shoes that ride in vertical channels within the jamb liners and lock in place when the sash is tilted inward. The shoes are biased upward by counterbalance springs, and locking the shoes in place when the sash tilts inward prevents the shoes from snapping upward, under the force of the counterbalance springs, when the sash is taken out. Tilt shoes, and the locking of tilt shoes in place in take-out jamb liners, have long been troublesome, though.

One way of locking tilt shoes in place is by a cam that enlarges a dimension of the shoe when the sash tilts so that the enlarged shoe locks within the channel in which the shoe rides. Examples of this include U.S. Pat. Nos. 3,789,549; 3,797,168; 3,844,066; 4,079,549; 4,227,345; 4,364,199; and 4,590,708. Such gripper mechanisms have proved unreliable against the slippery resin surfaces of the jamb liners. Cams in tilt shoes have also operated biter knives for biting into the jamb liner to lock the shoe against the spring force. Examples of this include U.S. Pat. Nos. 3,233,278; 3,524,282; 3,611,636; 4,271,631; 4,452,012; and 4,610,108. Such biter devices have marred the jamb liner surfaces so that movement of the shoes becomes bumpy and noisy.

We have devised an improved shoe for take-out sash running between take-out jamb liners. Our shoe locks in place with a biter knife, but the knife bites into a jamb liner surface that the shoe does not ride on so that shoe movement is not roughened by biter marks. Our shoe also locks in place when the sash is removed, rather than when the sash is tilted. This is both convenient and adequate, since the shoes do not spring upward until the weight of the sash is removed from them. Our shoe includes friction pads that can be adjusted with a screwdriver to vary the friction of the shoe within the jamb liner to compensate for hop and drop. Generally, our lock shoe system is inexpensive, reliable, durable, and easy and convenient to operate.

Another advantage of our lock shoes is that they make an audible sound as they latch onto sash pins, when a previously removed sash is returned to its position between a pair of jamb liners. The audible latching sound tells a person replacing the sash that its pins are properly latched into the lock shoes, and the sash is properly supported and counterbalanced.

SUMMARY OF THE INVENTION

Our audibly locking shoe system applies to a take-out window having take-out jamb liners with sash runs and vertically extending lock shoe channels within which a lock shoe moves vertically of the jamb liner. The jamb liners include sash pin slots, side walls of which extend laterally to form a pair of vertical fins within each of the lock shoe channels. Each of the lock shoes has bearing surfaces that engage and ride on sash side surfaces of the fins, and each of the lock shoes has a pivotally mounted biter knife disposed to bite into frame side surfaces of the fins opposite the sash side surfaces of the fins. Springs on the lock shoes bias the biter knives into biting position, and sash pins extending from the sash through the slots into engagement with the biter knives hold the biter knives out of biting position until removal of the sash from the jamb liners laterally removes the pins from the lock shoes. Then the springs pivot the biter knives to bite into frame side surfaces of the fins and lock the shoes in place until the sash is replaced and its pins reengage the biter knives.

The lock shoes also include spring-biased ramp latches that are pivotally mounted to allow the sash pins to move over the ramp latches, pivoting these aside, as the pins move into engagement with the biter knives, whereupon the ramp latches snap into lock position, holding the pins in engagement with the biter knives. Preferably a single spring, mounted on each lock shoe, biases both the biter knife and the ramp latch. When the ramp latches snap from a pivoted-aside position back to a latched position, they make an audible sound indicating that a sash pin has moved over a free end of a ramp latch and into a pin-receiving recess in the lock shoe. This sound indicates successful latching of the lock shoe onto the sash pin, telling the user that the sash is returned to a counterbalanced position. The lock shoes also preferably include friction pads engaging side surfaces of the pin slots and a screw arranged to adjust the frictional force of the pads against the slot surfaces to compensate for hop and drop.

DRAWINGS

DETAILED DESCRIPTION

Figure 1:
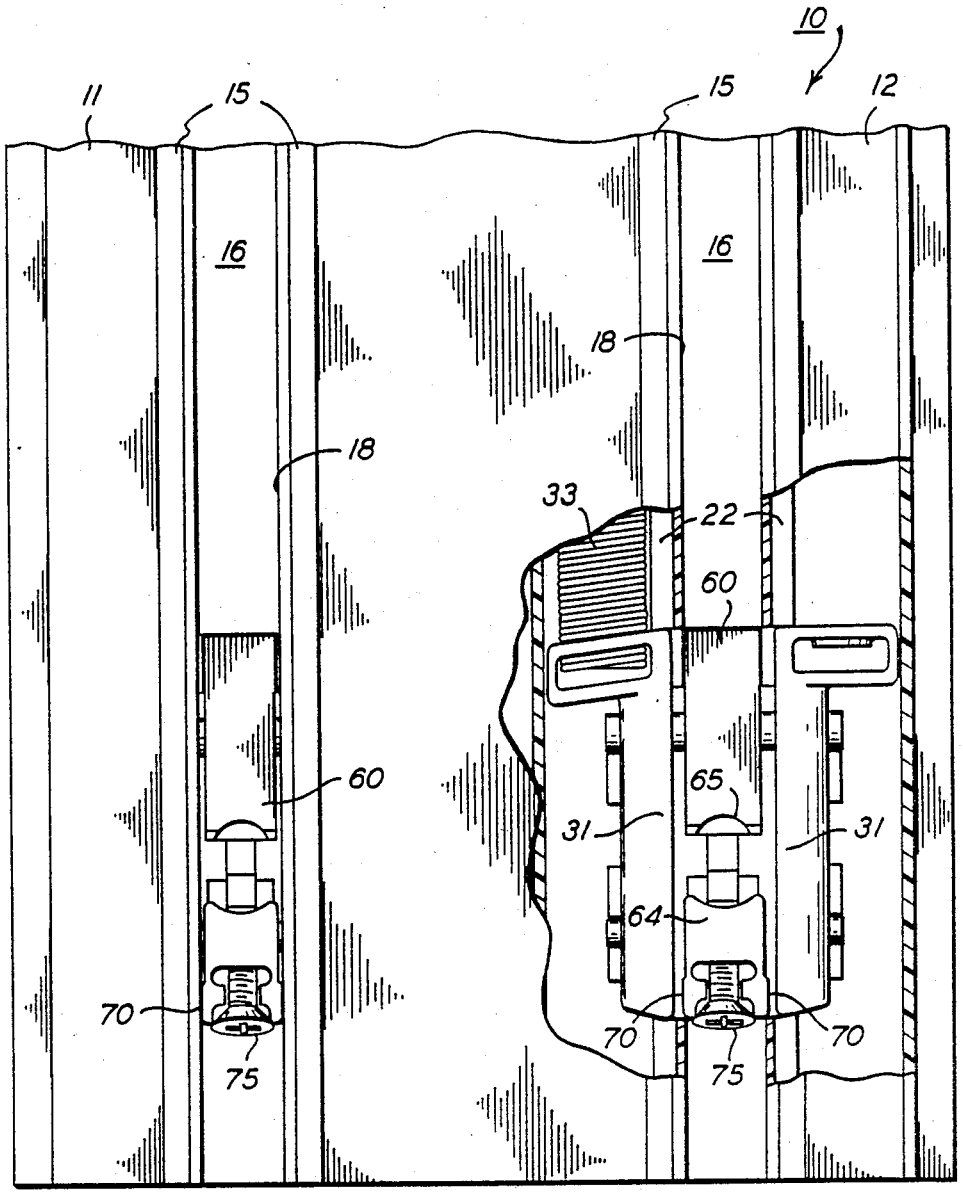
FIG. 1 is a partially cutaway, fragmentary elevational view of a take-out jamb liner having a preferred embodiment of our lock shoe system.
Figure 2:
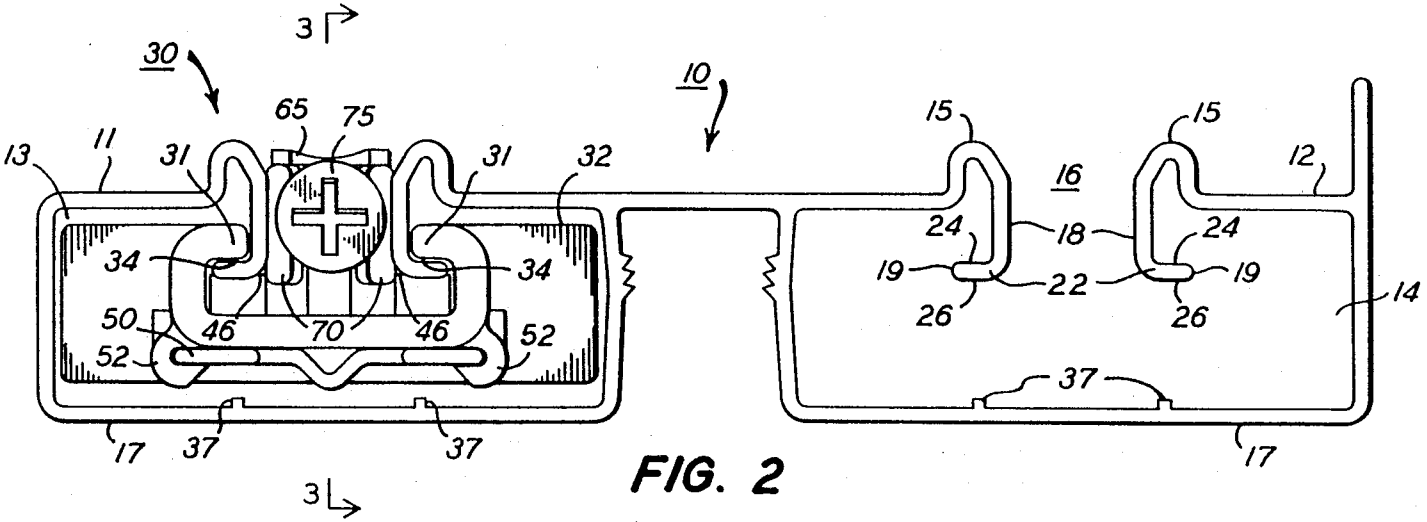
FIG. 2 is a bottom end view of the jamb liner of FIG. 1, with the right side lock shoe removed.
Figure 3:
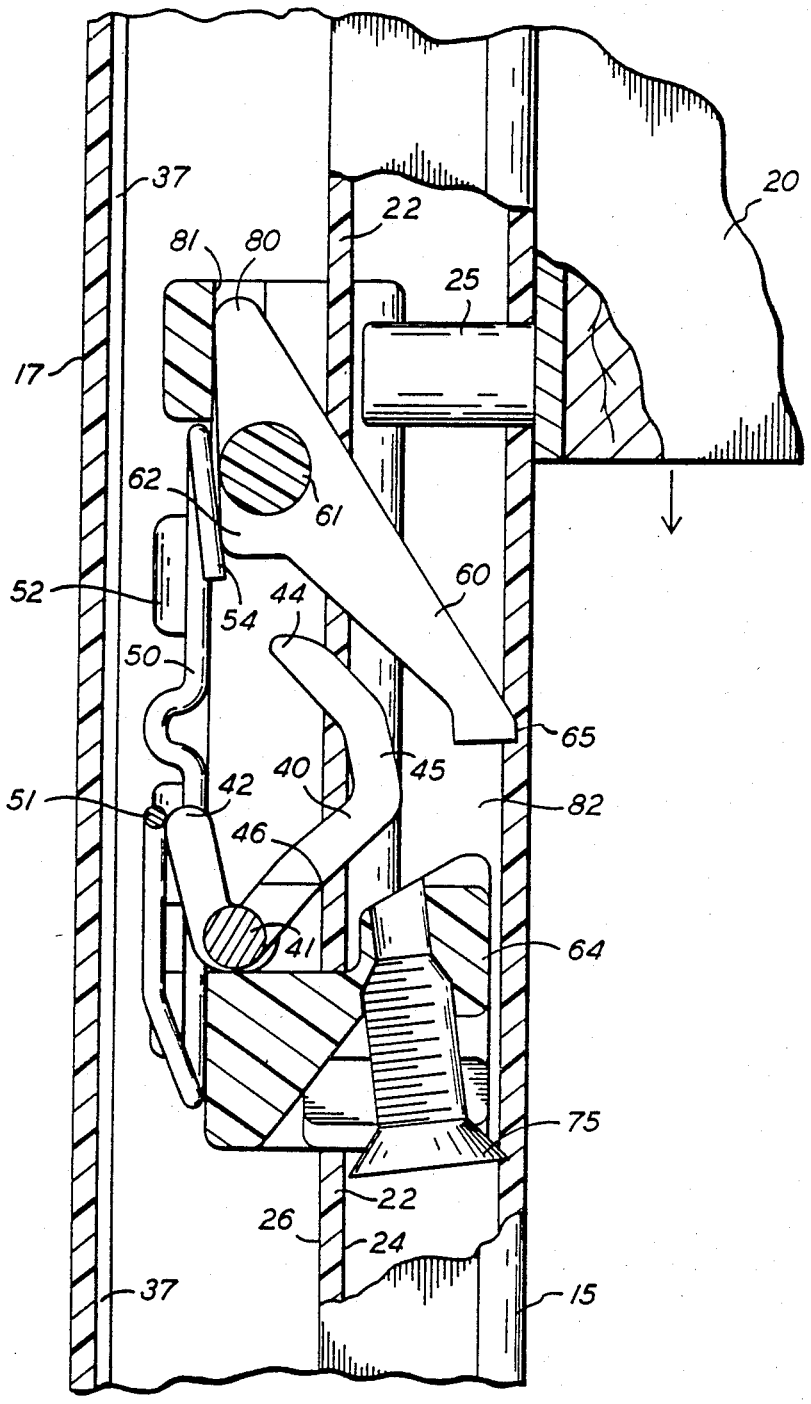
FIGS. 3–5 are cross-sectional views of the lock shoe of FIG. 2, taken along the line 3—3 thereof and partially cutting away the jamb liner, to show respectively a locked position, an unlocked position with a sash pin reentering the lock shoe, and an unlocked position with a sash pin latched into the lock shoe.
Figure 4:
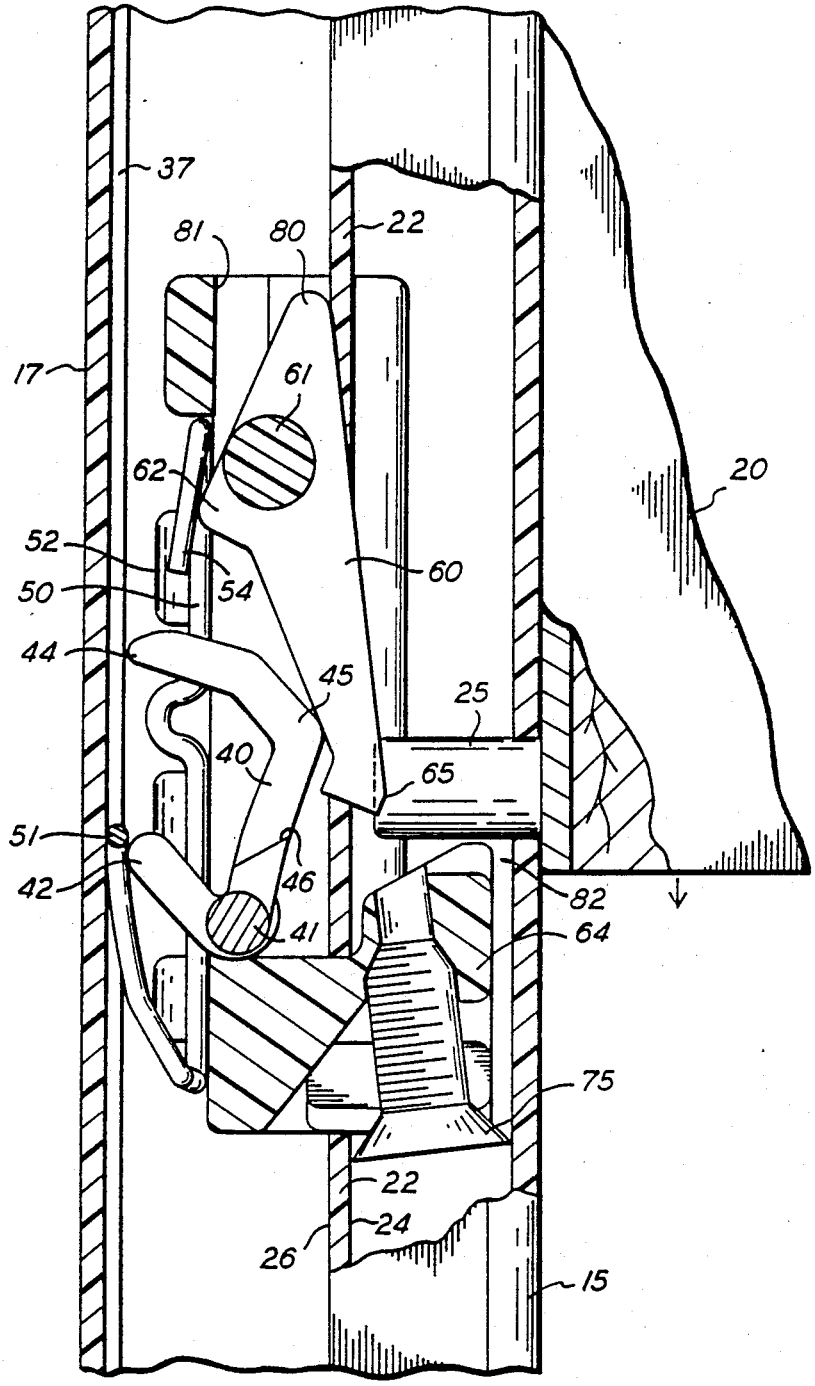
Figure 5:
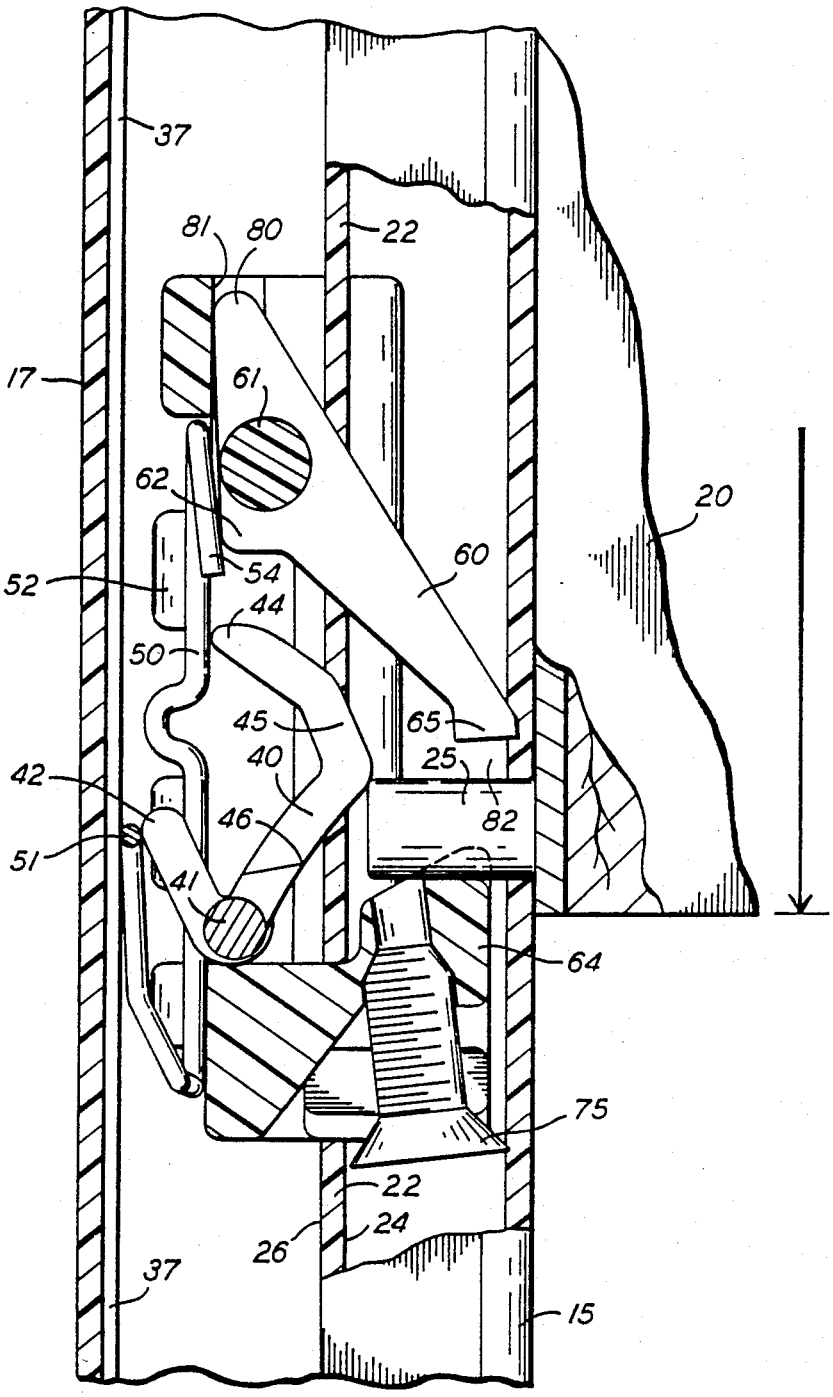

Take-out jamb liner 10, as shown in FIGS. 1 and 2, has a pair of sash runs 11 and 12 on a frame side of which are respective lock shoe channels 13 and 14. Ridges 15, on opposite sides of sash pin slots 16, guide sashes 20 in the sash runs, and sash pins 25 extend into slots 16, as shown in FIGS. 3–5. A generally flat backside 17 of jamb liner 10 fits against a window frame and disposes sash runs 11 and 12 to confront the stiles of respective sashes 20.

The side walls 18 of slots 16 extend vertically of jamb liner 10 and also extend into lock shoe channels 13 and 14 where the free ends 19 of side walls 18 extend laterally outward. The lateral extensions of side walls 18 form fins 22, which have sash side surfaces 24, facing toward sash runs 11 and 12, and have frame side surfaces 26, facing away from sash runs 11 and 12 and toward the frame side 17 of jamb liner 10.

Figure 6:
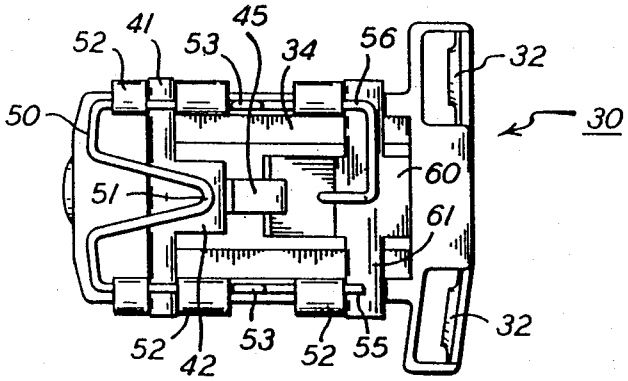
FIG. 6 is a bottom view of the lock shoe of FIGS. 1–4.

Lock shoes 30, which run vertically in channels 13 and 14, ride on fins 22. Inturned edges 31 of lock shoes 30 have bearing surfaces 34 that engage sash side surfaces 24 of fins 22 so that lock shoes 30 ride just clear of ribs 37 on the backs of channels 13 and 14. Edges 31 and bearing surfaces 34 preferably extend for the full length of lock shoes 30, as shown in FIGS. 1 and 6.

A locking device, such as a biter knife 40, is pivotally mounted on lock shoe 30 and has a pair of knife edges 46 that can bite into frame side surfaces 26 of fins 22, as shown in FIGS. 2 and 3. Other locking devices, such as a cam-operated lock, can also be mounted on lock shoe 30 to hold shoe 30 in place in channel 13 or 14, against the force of counterbalance spring 33, when sash 20 is removed. The preferred biter knife 40 has a pivot shaft 41 that is pivotally trapped in place on lock shoe 30 and allows biter knife 40 to pivot between the locking position shown in FIGS. 2 and 3, where knife edges 46 bite into fin surfaces 26, and the unlocked position of FIGS. 4 and 5, where sash pin 25 holds biter knife 40 clear of fins 22. Biter knife 40 also has an arm 45 engaged by sash pin 25, as shown in FIG. 5, and a lever arm 42 engaged by a loop 51 of a spring 50. Spring 50 is trapped under side projections 52 spaced along the bottom edges of lock shoe 30, where a short reach 53 of spring 50 traps pivot shaft 41 of biter knife 40.

Also mounted on lock shoe 30 is a ramp latch 60 having a pivot shaft 61 and a lever arm 62 biased by an end 54 of spring 50 to the latched position shown in FIGS. 3 and 5. Another end 55 and a reach 56 of spring 50 trap pivot shaft 61 of ramp latch 60 rotatably in place on shoe 30. In the latched position shown in FIGS. 3 and 5, a heel 80 of ramp latch 60 engages an abutment surface 81 on lock shoe 30. A free end 65 of ramp latch 60 is preferably rounded, as shown in FIGS. 1 and 2, to fit around sash pin 25, which fits into a pin-receiving recess 82 between free end 65 and abutment surface 64. A pin 25 of sash 20 can be removed laterally from recess 82, but is blocked from vertical movement out of recess 82 on the upside by free end 65 of ramp latch 60 and on the down side by abutment 64.

Sash 20 can be removed from lock shoes 30 by tilting sash 20 so that its bottom region moves inward from the plane between jamb liners 10, and then angling sash 20 so that one of its pins 25 is more elevated than the other. This pulls pins 25 laterally out from recesses 82, which releases arms 45 of biter knives 40, to pivot and bite. This locks shoes 30 against moving upward in response to the bias of counterbalance springs 33.

When sash 20 is to be replaced, after having been removed, its upper region is angled and maneuvered between jamb liners 10 so that pins 25 enter slots 16 above the positions where shoes 30 are locked in place. The upper region of sash 20 can then be leveled and lowered so that pins 25 move downward onto locked shoes 30, as shown in FIGS. 3–5. As pins 25 move downward, they ride over ramp latches 60, pivoting ramp latches 60 from the latched position of FIG. 3 to the pivoted-aside position of FIG. 4. As a sash pin 25 slides over the free end 65 of a ramp latch 60 and drops into pin-receiving recess 82 of shoe 30, it releases ramp latch 60 to pivot under the bias of spring 50 and snap back into the latched position shown in FIGS. 3 and 5. As this occurs, heel 80 snaps against abutment surface 81, making an audible sound that indicates the latching of pin 25 into recess 82. In this latched position, sash pin 25 engages arm 45 of biter knife 40 and holds knife edges 46 clear of fin surfaces 26, and sash pin 25 is also locked vertically between abutment 64, which is preferably rounded to receive sash pin 25, and the rounded end 65 of ramp latch 60.

While a sash pin 25 slides downward over ramp latch 60, in the position shown in FIG. 4, ramp latch 60 overlaps and depresses a nose 44 of biter knife 40, to unlock shoe 30. This releases shoe 30 to move upward under the bias of counterbalance spring 33, so that shoe 30 snaps up into engagement with sash pin 25. The effect is to snap abutment surface 64 against the underside of pin 25, further contributing to the audible sound made as pin 25 enters recess 82.

Another feature of lock shoe 30 is a pair of friction pads 70 that engage side surfaces 18 of slot 16 and can be variably spread apart by adjustment screw 75. As screw 75 is turned deeper in between friction pads 70, its head spreads pads 70 farther apart and presses them more tightly against slot side walls 18. This increases the friction of moving shoe 30 up and down in a shoe channel 13 or 14. Such friction can compensate for hop and drop of a sash 20, and screw 75 is conveniently available for adjustment by a screw driver inserted into a slot 16 near the bottom corner of sash 20.

In operation, with sash 20 positioned in a sash run, sash pins 25 extend into slots 16 and into pin-receiving recesses 82 in lock shoes 30. There they engage arms 45 of biter knives 40, holding knife edges 46 clear of the frame side surfaces 26 of fins 22. This frees shoes 30 to move vertically within shoe channels 13 or 14 in jamb liners 10. At least one of the spring connectors 32 at the upper end of lock shoes 30 are connected to a spring 33 that biases shoes 30 upward to counterbalance sash 20. If the weight of sash 20 and the force of balance springs 33 produces hop or drop, screws 75 can be respectively tightened or loosened to compensate. Sash 20 then runs smoothly up and down one of the sash runs 11 or 12; and as this occurs, bearing surfaces 34 on shoes 30 ride against the sash side surfaces 24 of fins 22.

Sash 20 can be tilted inward, because pins 25 are rotatable within shoes 30, and ridges 15 are flexible enough to accommodate such tilting motion. This can be done for washing the glass in sash 20 without removing sash 20 from in between jamb liners 10. Such tilting movement does not remove pins 25 from shoes 30 and does not lock biter knives 40 in place.

Sash 20 can also be removed from between jamb liners 10, and this is done by side tilting or angling a sash that has been tilted inward so that shoes 30 move to different heights on opposite sides of the sash. This removes pins 25 laterally from shoes 30, so that spring loops 51, engaging lever arms 42, pivot biter knives 40 into locking positions in which knife edges 46 bite into frame side surfaces 26 of fins 22. This does not mar bearing surfaces 24 on the opposite sides of fins 22, against which surfaces 34 of shoes 30 continue to ride smoothly. With knives 40 in biting position, shoes 30 are locked in channels 13 and 14 against the upward force of balance springs 33. Once removed, sash 20 could have its glass replaced, for example.

To replace sash 20 in between jamb liners 10 only requires angling the sash so that its pins 25 enter slots 16 above the positions where shoes 30 are locked in place. Then the upper region of sash 20 is leveled, and sash 20 is lowered to bring its pins 25 down onto ramp latches 60, to pivot them aside as shown in FIG. 4. As ramp latches 60 pivot against biter knives 40, they unlock knife edges 46, as shown in FIG. 4. When this occurs, shoes 30 snap upward under the bias force of counterbalance springs 33. This snaps abutments 64 into engagement with pins 25 and lets ramp latches 60 snap into latched position behind pins 25. This transfers the weight of sash 20 to shoes 30 and counterbalance springs 25 and holds biter knives 40 out of biting position by means of the engagement of pins 25 with arms 45 of biter knives 40. The snapping of pins 25 into latch position in recesses 82 also produces audible sound from heel 80 of ramp latch 60 snapping into contact with abutment 81 and from abutment 64 snapping into contact with pin 25. The sound of these contacts tells the user that a pin 25 has properly latched into position in a lock shoe 30. Since lock shoes 30 are left at different elevations when sash 20 is withdrawn, the lowering of sash pins 25 in positions level with each other, to engage shoes 30 in their locked position, produces a first sound when one pin 25 latches into the upper shoe 30 and a second sound when another pin 25 latches into the lower shoe 30. The pair of audible sounds occurring in sequence then tells the user that each pin 25 is latched into a shoe 30 and that the weight of sash 20 is properly borne by counterbalance springs 30.

Once pins 25 have slid down to the latched position shown in FIG. 5, and ramp latches 60 have snapped into their latched positions, pins 25 are retained against any vertical movement out of pin-receiving recesses 82. Free ends 65 of ramp latches 60 prevent upward movement of pins 25 from recesses 82, and abutments 64 prevent downward movement of pins 25 from recesses 82. Since pins 25 can pivot in their recesses 82, counterbalanced sash 20 can then be tilted back into alignment with its sash run.

Operation of biter knives 40 only when sash 20 is removed from between jamb liners 10 minimizes the biting action of knives 40 and uses this only when necessary because of removal of the sash weight from shoes 30. The biting process, no matter how many times employed, does not interfere with smooth vertical movement of shoes 30, which do not engage or ride on bite surface 26.

Tilting, removing, and replacing sash 20 is simple and convenient, especially since sash pins 25 do not have to be laterally inserted into shoes 30 and can be latched into shoes 30 simply by lowering pins 25 from above shoes 30. Our lock shoe system is also economical in using simple components molded of resin material, a single wire spring 50, a cast metal biter knife 40, and an inexpensive screw 75. Yet, the lock shoe system reliably performs every desired function and remains durable for long service.

WE CLAIM:

1. A take-out sash shoe configured for moving vertically in a channel in an extruded resin jamb liner where said sash shoe receives and moves with a pin of a take-out sash, said pin being laterally withdrawn from said sash shoe when said sash is taken out of said jamb liner, and said sash shoe comprising:

a. a spring-biased ramp latch pivotally mounted on said sash shoe so that a free end of said ramp latch is adjacent a recess in said shoe for receiving said pin;

b. said ramp latch being mounted to pivot from a latch position toward a frame side of said channel when a previously withdrawn pin moves vertically over said ramp latch as said withdrawn pin returns toward said recess in said shoe;

c. said spring-biased ramp latch being arranged to snap into said latch position as said pin moves over said free end of said ramp latch and into said pin-receiving recess so that said ramp latch, in said latch position, locks said pin against vertically moving from said recess; and d. the snapping of said ramp latch into said latch position being arranged for producing an audible sound indicating that said sash pin is latched into said sash shoe.

2. The sash shoe of claim 1 wherein said ramp latch is arranged above said recess so that said withdrawn pin moves downward over said ramp latch to enter said recess.

3. The sash shoe of claim 1 including friction surfaces arranged for adjustably engaging surfaces of said channel to vary the frictional resistance of vertical movement of said sash shoe within said channel.

4. The sash shoe of claim 1 including a lock device for holding said sash shoe against vertical movement in said channel when said pin is laterally withdrawn from said recess.

5. The sash shoe of claim 4 wherein said lock device is released by pivotal movement of said ramp latch in response to said pin moving over said ramp latch.

6. A method of replacing a take-out sash between a pair of jamb liners respectively carrying lock shoes movable in vertical channels in said jamb liners, said lock shoes being connected to counterbalance springs and said sash having an opposed pair of sash pins, said method comprising:

a. maneuvering said sash to insert said sash pins into slots in said jamb liners so that said sash pins extend into said channels in said jamb liners in regions above said lock shoes;

b. moving said sash downward so that said pins move downward in said slots into engagement with said lock shoes where said downwardly moving sash pins engage pivotal ramp latches mounted on said lock shoes;

c. moving said sash and said sash pins further downward so that said sash pins move over and pivot said ramp latches as said pins approach pin-receiving regions of said lock shoes, until said pins move down over free ends of said ramp latches and into said pin-receiving regions, allowing said ramp latches to snap into latched positions behind said sash pins; and d. using the audible sound produced by snapping of each of said ramp latches into said latched positions to indicate the latching of each of said latch pins into respective ones of said lock shoes to show that said sash is properly latched into a supported position between said lock shoes.

7. The method of claim 6 including arranging lock mechanisms for each of said lock shoes to be unlocked as said pins move downward over said ramp latches.

8. The method of claim 6 including returning said sash to a vertical plane between said jamb liners for moving vertically with said counterbalanced lock shoes, after determining from said audible sound that said sash pins are latched into said lock shoes.

9. A lock shoe for a take-out window having an extruded resin jamb liner with a sash pin slot and a channel for vertical movement of said lock shoe while engaging a pin of a take-out sash, said lock shoe comprising:

a. said lock shoe having a pin-receiving region where said sash pin engages said lock shoe during vertical movement of said sash within said jamb liner and during tilting movement of said sash relative to said jamb liner;

b. a ramp latch pivotally mounted on said lock shoe and inclined toward said pin-receiving region so that when said sash pin has been laterally withdrawn from said pin-receiving region and is to be returned to said pin-receiving region, said sash pin can be moved vertically in said slot over said ramp latch to pivot said ramp latch aside as said sash pin approaches said pin-receiving region;

c. said ramp latch being spring biased for snapping into a latch position as said pin enters said pin-receiving region so that said ramp latch, in said latch position, holds said pin against vertical withdrawal from said pin-receiving region of said lock shoe; and d. said ramp latch being arranged so that said snapping into said latch position makes an audible sound informing a person replacing said sash that said sash pin is latched into said pin-receiving region of said lock shoe.

10. The lock shoe of claim 9 including a pair of said lock shoes arranged respectively in a pair of said jamb liners on opposite sides of said sash having a pair of said pins so that said audible sound from each of said lock shoes indicates that each of said sash pins is latched in each respective one of said lock shoes.

11. The lock shoe of claim 9 wherein said ramp latch is arranged above said pin-receiving region so that said sash pin moves downward over said ramp latch into said pin-receiving region.

12. The lock shoe of claim 9 including a biter knife mounted in said pin-receiving region to lock said shoe vertically within said channel when said sash pin is laterally withdrawn from said pin-receiving region.

13. The lock shoe of claim 12 including a spring arranged on said lock shoe for biasing both said biter knife and said ramp latch.

14. The lock shoe of claim 12 wherein said ramp latch is arranged above said pin-receiving region so that said sash pin moves downward over said ramp latch into said pin-receiving region, and said ramp latch is arranged for disengaging said biter knife from a lock position as said sash pin pivots said ramp latch aside while enroute to said pin-receiving region.

15. The lock shoe of claim 9 wherein said ramp latch has a free end adjacent said pin-receiving region, and said ramp latch snaps into said latch position as said pin moves beyond said free end of said ramp latch.

16. A lock shoe system including a pair of lock shoes connected respectively to counterbalance springs and arranged within a pair of extruded resin jamb liners of a take-out window system having a take-out sash with a pair of sash pins that extend through vertical slots in said jamb liners into vertical channels in said jamb liners where said lock shoes move with said sash, said lock shoe system comprising:

a. means engaged by said sash pins for locking said lock shoes against upward movement in response to said counterbalance springs, when said lock shoes are lightened of downward force from the weight of said sash;

b. ramp latches respectively mounted for pivoting on said lock shoes to allow said sash pins to move vertically in said slots to engage and ride over said ramp latches enroute to engagement with said locking means;

c. said ramp latches being arranged to snap into latched positions after said pins move beyond free ends of said ramp latches and into engagement with said locking means so that said ramp latches hold said pins against vertically moving out of engagement with said locking means; and d. said ramp latches being arranged so that snapping into said latched positions behind said pins makes audible sounds indicating that said sash pins are properly latched into supported positions in said lock shoes.

17. The lock shoe system of claim 16 wherein said ramp latches are arranged above said locking means, and said sash pins move downward over said ramp latches enroute to said engagement with said locking means.

18. The lock shoe system of claim 16 wherein said locking means is a biter knife that locks against a surface of said jamb liner.

19. The lock shoe system of claim 16 wherein said ramp latches engage and unlock said locking means as said pins ride over said ramp latches.

* * * * *